US009243479B2

(12) United States Patent
Nygardsvoll et al.

(10) Patent No.: US 9,243,479 B2
(45) Date of Patent: Jan. 26, 2016

(54) GRAVEL PACKING METHOD FOR MULTILATERAL WELL PRIOR TO LOCATING A JUNCTION

(75) Inventors: Kjell Nygardsvoll, Rio de Janerio (BR); Mark E. Ramey, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 708 days.

(21) Appl. No.: 13/485,563

(22) Filed: May 31, 2012

(65) Prior Publication Data

US 2013/0319666 A1 Dec. 5, 2013

(51) Int. Cl.
*E21B 43/04* (2006.01)
*E21B 41/00* (2006.01)

(52) U.S. Cl.
CPC ..... *E21B 43/04* (2013.01); *E21B 41/0035* (2013.01)

(58) Field of Classification Search
CPC ..... E21B 43/04; E21B 7/061; E21B 43/305; E21B 43/045; E21B 43/08; E21B 41/0035; E21B 41/0042; E21B 29/06
USPC ..... 166/278, 51, 50, 117.5, 117.6
See application file for complete search history.

(56) References Cited

U.S. PATENT DOCUMENTS

| | | | | |
|---|---|---|---|---|
| 7,905,279 | B2 | 3/2011 | Hart et al. | |
| 8,403,064 | B2 * | 3/2013 | Allen | 166/377 |
| 2010/0314109 | A1 * | 12/2010 | Garcia et al. | 166/278 |

OTHER PUBLICATIONS

Baker Hughes Incorporated, Technical Unit No. TU 10589, Liner Hangers—Liner Setting Tools, Accessories and Packoff's, Jun. 2011, 2 pages.

* cited by examiner

*Primary Examiner* — Shane Bomar
*Assistant Examiner* — Wei Wang
(74) *Attorney, Agent, or Firm* — Steve Rosenblatt

(57) ABSTRACT

A lateral is gravel packed without a junction in place in a single trip into the wellbore. A disconnect is provided between the isolation packer in the lateral and a main bore packer. The inner string assembly in the gravel packing completion releases a disconnect with a shift tool and then releases the main bore packer so that the inner string assembly takes out the main bore packer and the upper portion of the disconnect when pulling out of the hole. A junction is then placed into the main and lateral legs with a packer having a seal bore into which the production string is sealingly stabbed to produce out of the main bore and/or the just completed lateral.

16 Claims, 8 Drawing Sheets

GRAVEL PACKING METHOD FOR MULTILATERAL WELL PRIOR TO LOCATING A JUNCTION

FIELD OF THE INVENTION

The field of the invention is gravel packing and more specifically gravel packing a lateral before placing a junction in position so that a larger completion can be used in the lateral before placement of the junction at the lateral.

BACKGROUND OF THE INVENTION

Multilateral wells are used to continue or enhance production from a well into a given formation or into several formations. Typically a whipstock in placed in the main bore and properly oriented and a series of mills form a window or opening in the cased hole to initiate the lateral. The window mills can then be removed, a junction placed at the lateral to connect the main bore and the lateral window just opened and the lateral fully drilled. Subsequently, the lateral is completed with a gravel packing assembly that includes sections of screen supported by an isolation packer that is run in with an inner assembly that includes a wash pipe, a crossover and a shifting tool. After the gravel packing is completed, the inner string is removed and a production string is tagged into the isolation packer and production commences.

One of the problems with this order of events in placing the junction in position and running the bottom hole assembly for gravel packing through the junction is that the presence of the junction limits the size of the completion equipment, which then can limit the rate of subsequent production from the lateral. The present inventions overcomes this problem by running in a bottom hole assembly into the lateral and performing the gravel packing without the junction in position. Instead a main bore packer is provided in the string above the isolation packer that prevents getting gravel in the main bore. A disconnect is placed between the main bore packer and the isolation packer in the lateral. The gravel packing of the lateral without the junction in position can also be accomplished in a single trip because the main bore packer can be brought out with the inner string in the lateral to save rig time. These and other aspects of the present invention will be more apparent to those skilled in the art from a review of the specification and associated drawings while recognizing that the full scope of the invention is to be determined from the appended claims.

Locking tools are sold by Baker Hughes Incorporated under the names AF and HF Sur-Set Top No-Go Lock Assembly. Baker Hughes also sells Liner Setting Tools with a release feature such as the HRD-E model.

A combination whipstock and seal bore tool that is installed in a single trip is described in U.S. Pat. No. 7,905,279.

SUMMARY OF THE INVENTION

A lateral is gravel packed without a junction in place in a single trip into the wellbore. A disconnect is provided between the isolation packer in the lateral and a main bore packer. The inner string assembly in the gravel packing completion releases a disconnect with a shift tool and then releases the main bore packer so that the inner string assembly takes out the main bore packer and the upper portion of the disconnect when pulling out of the hole. A junction is then placed into the main and lateral legs with a packer having a seal bore into which the production string is sealingly stabbed to produce out of the main bore and/or the just completed lateral.

DETAILED DESCRIPTION OF THE PREFERRED EMBODIMENT

Figure 1:
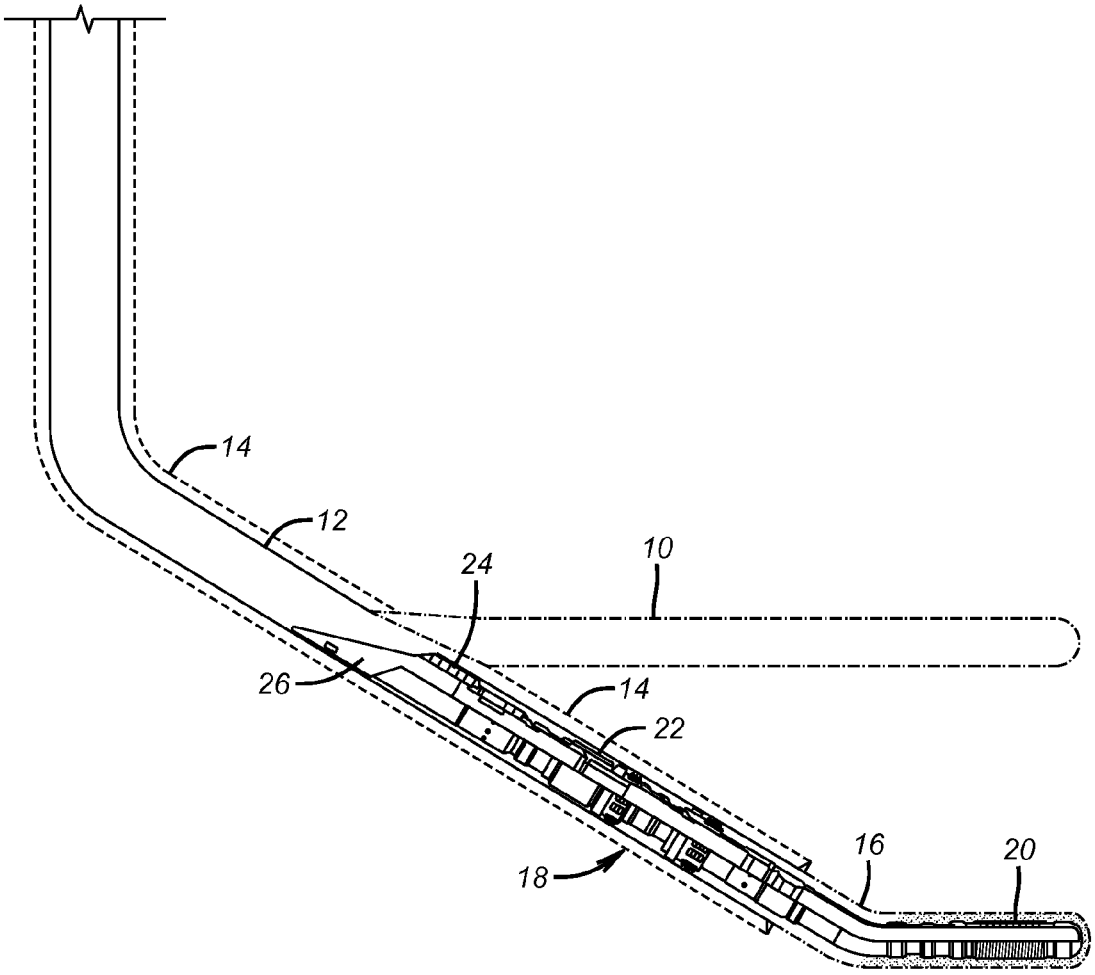
FIG. 1 shows a lateral drilled and a sand control completion in the main bore below.

FIG. 1 illustrates a lateral 10 that has been conventionally drilled through casing 12 in main bore 14. The main bore 14 continues as open hole 16 and for illustrative purposes shows a gravel pack assembly 18 that has screens 20 near the lower end as part of an outer assembly supported from isolation packer/hanger 22 located in the cased portion of the main bore 14. Above the packer/hanger 22 is a combination anchor and seal sub 24 into which is a whipstock 26 of the type described in U.S. Pat. No. 7,905,279. All the FIG. 1 completion equipment is known in the art and is optionally shown there for illustrative purposes. Those skilled in the art realize that another completion or no completion can be in the main bore except for example equipment that will later accept a junction as will be described below. For Example, the seal sub 24 that has an anchor feature can be there without the whipstock 26 such that a junction can be connected directly as will be described below.

Figure 2:
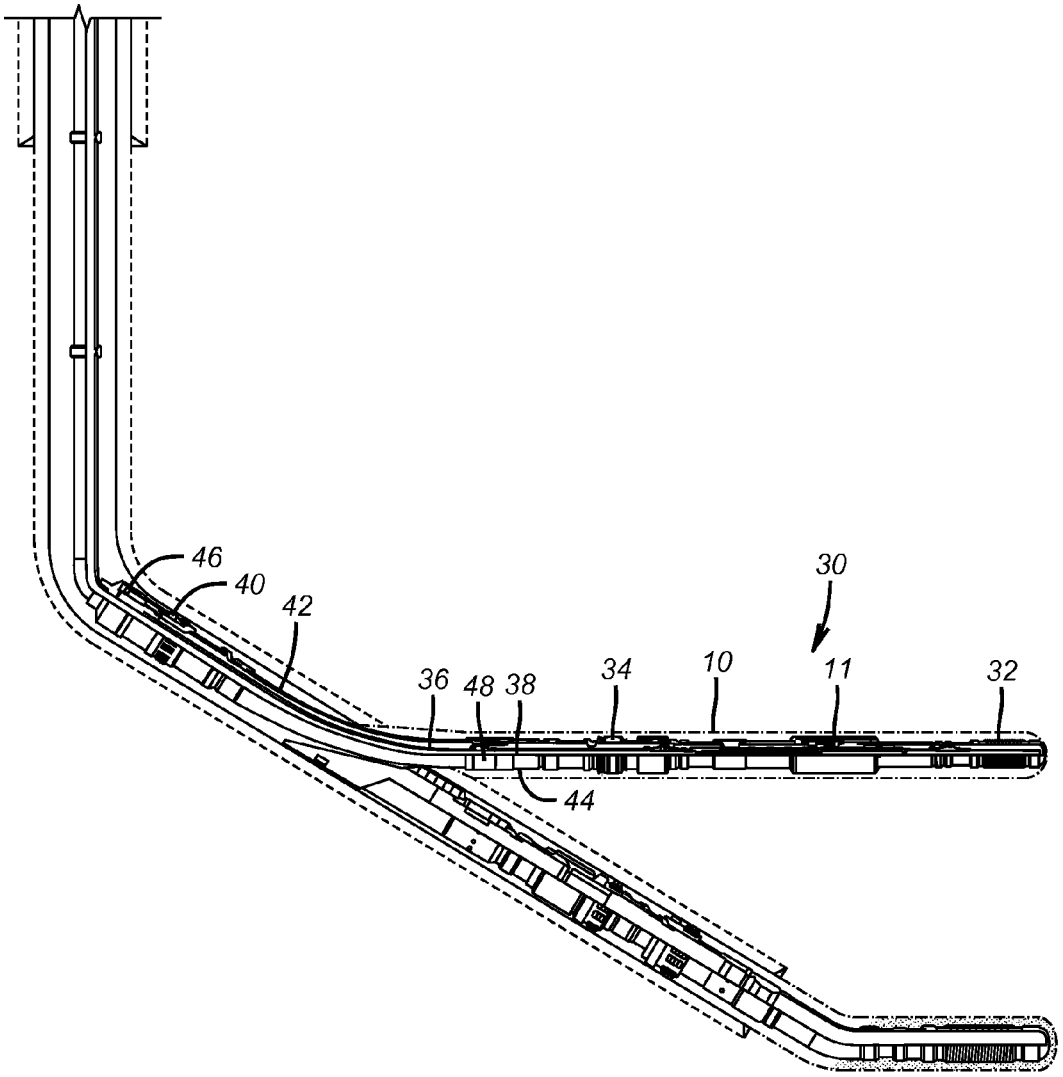
FIG. 2 is the view of FIG. 1 with a sand control completion in the lateral and a disconnect between the packer in the lateral and the packer in the main bore.

In FIG. 2 the lateral now has a gravel packing assembly 30 that for the most part has conventional elements such as a screen assembly 32, a crossover 11 and an isolation packer 34 among other stock components. An inner string 36 extends through the assembly 30 and through a new component in the assembly 30 which is a disconnect 38 that will be described in detail below. The inner string 36, apart from supporting the assembly 30 also supports a main bore packer 40 and a spacer 42 that allows the proper placement of the seal bore 44 associated with the disconnect 38 in the lateral 10 and the main bore packer 40 in the main bore 14. A running and setting tool 46 is associated with the main bore packer 40 for setting it and releasing from it. Isolation packer 34 is conventionally set such as by dropping a ball on a seat, not shown, and pressuring up. In fact both packers 34 and 40 can be set at the same time that way. The gravel packing of the lateral 10 begins after it is ascertained at the surface that the inner string 36 is clear to move relative to the outer assembly that includes the screens 32 and the isolation packer 34 that supports the screens 32. The gravel slurry can be deposited outside the screens 32 with the carrier fluid forced into the formation in the lateral 10. Excess gravel can be reversed out after the disconnect 48 is parted and the main bore packer 40 is released in a procedure that is known in the art. The purpose of the main bore packer 40 is to isolate the main bore 14 from the lateral 10 during the gravel packing.

Figure 3:
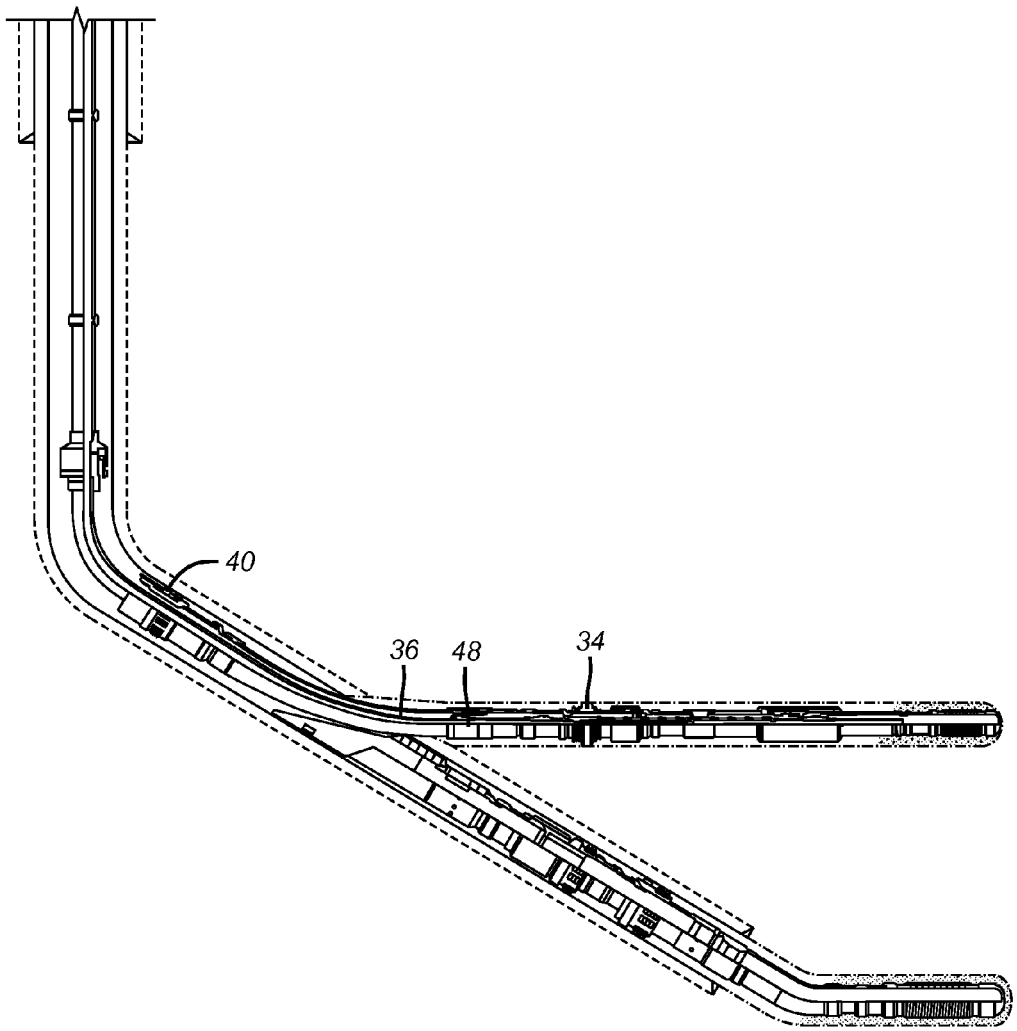
FIG. 3 is the view of FIG. 2 after the gravel packing where the inner string is raised to release the disconnect and then the main bore packer.
Figure 4:
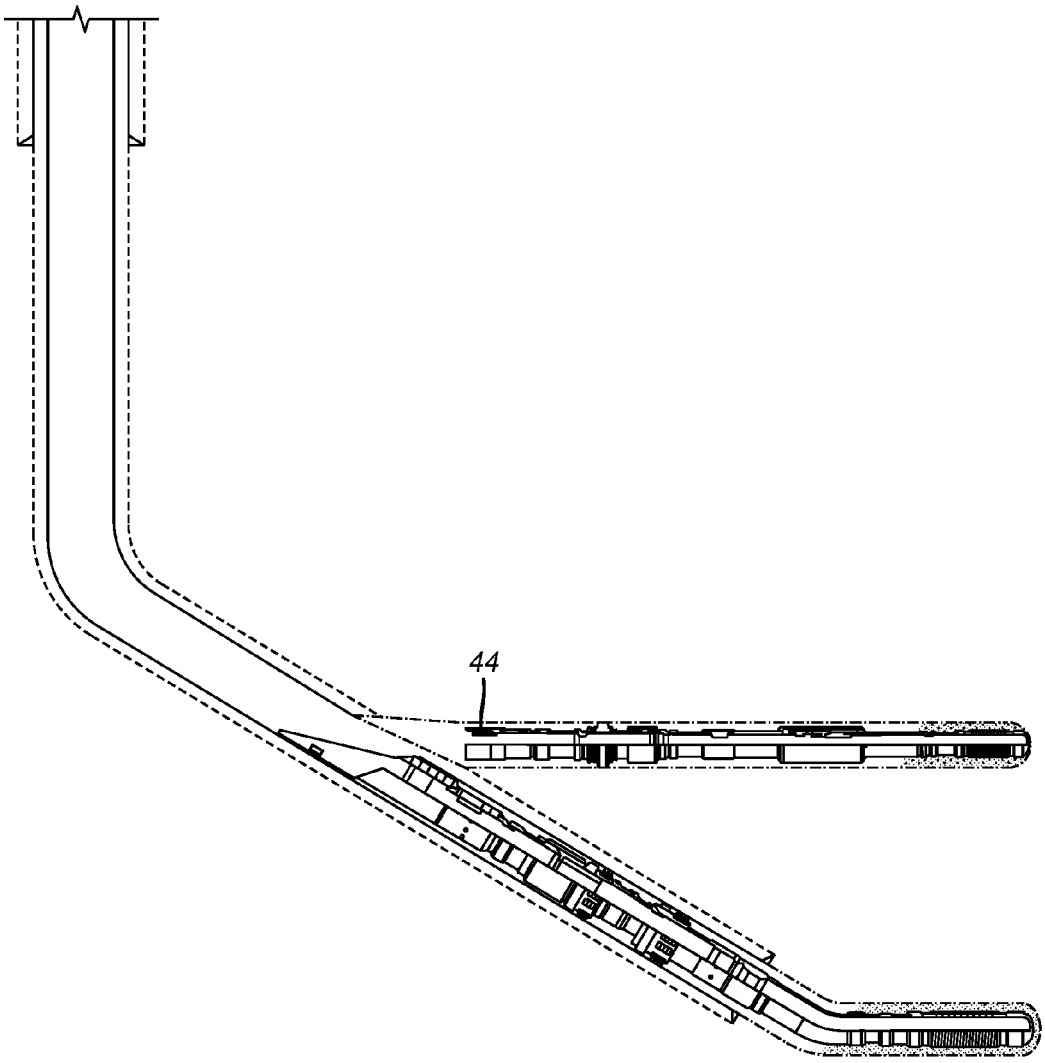
FIG. 4 is the view of FIG. 3 with the inner string and main bore packer removed leaving behind a part of the disconnect in the lateral for subsequent attachment of the junction.
Figure 5:
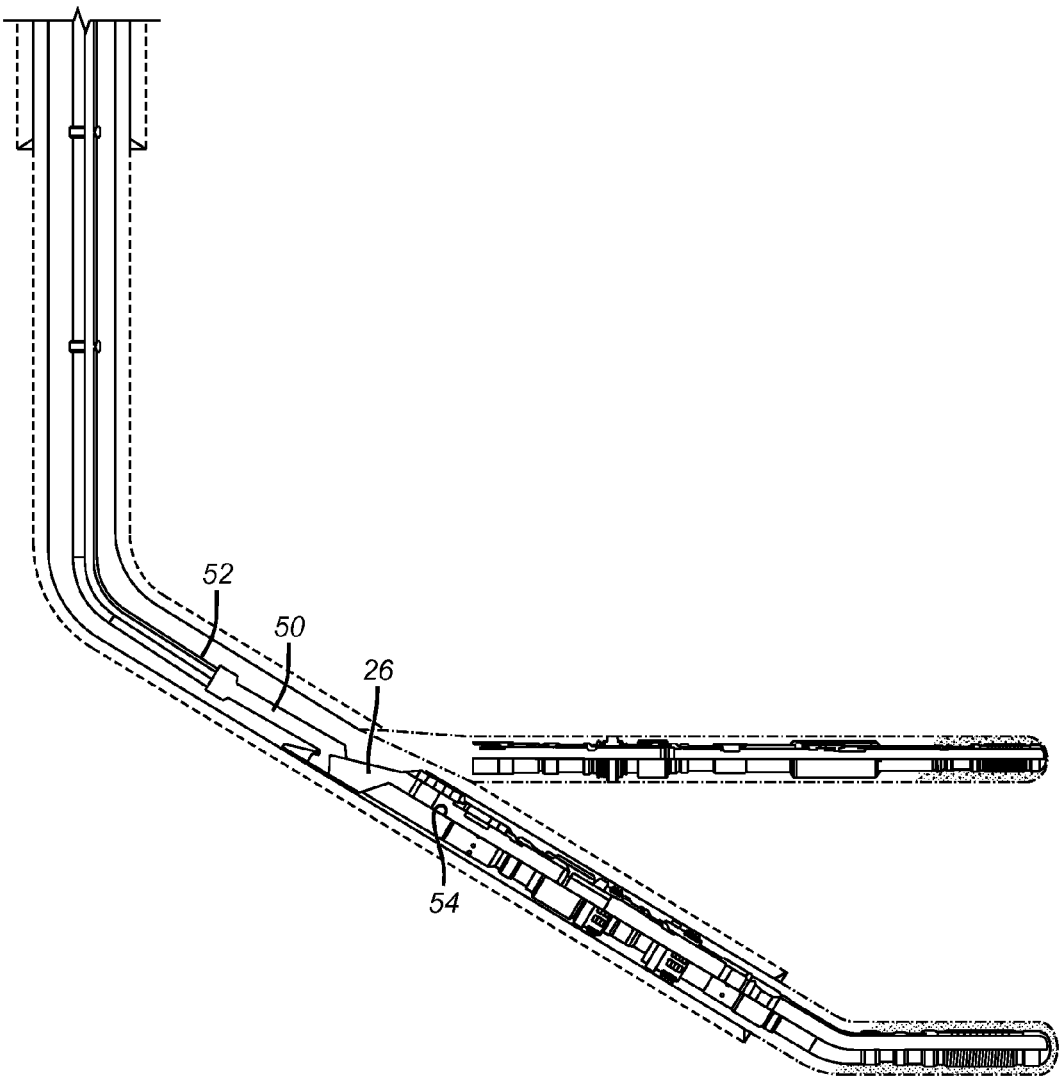
FIG. 5 is the view of FIG. 4 showing the retrieving tool removing the whipstock to expose the seal bore below.

In FIG. 3 the inner string 36 has been raised to release the disconnect 48 and then the packer 40 while leaving packer 34 set. The inner string 36 now takes with it the packer 40 and the upper half of the disconnect 48 leaving exposed a seal bore 44. FIG. 4 shows the exposed seal bore 44 after the packer 40 and part of the disconnect 48 are removed with the inner string 36. In FIG. 5 a string 52 supports a retrieval tool 50 to attach to a window in the whipstock 26 to remove it and expose a seal bore 54.

Figure 6:
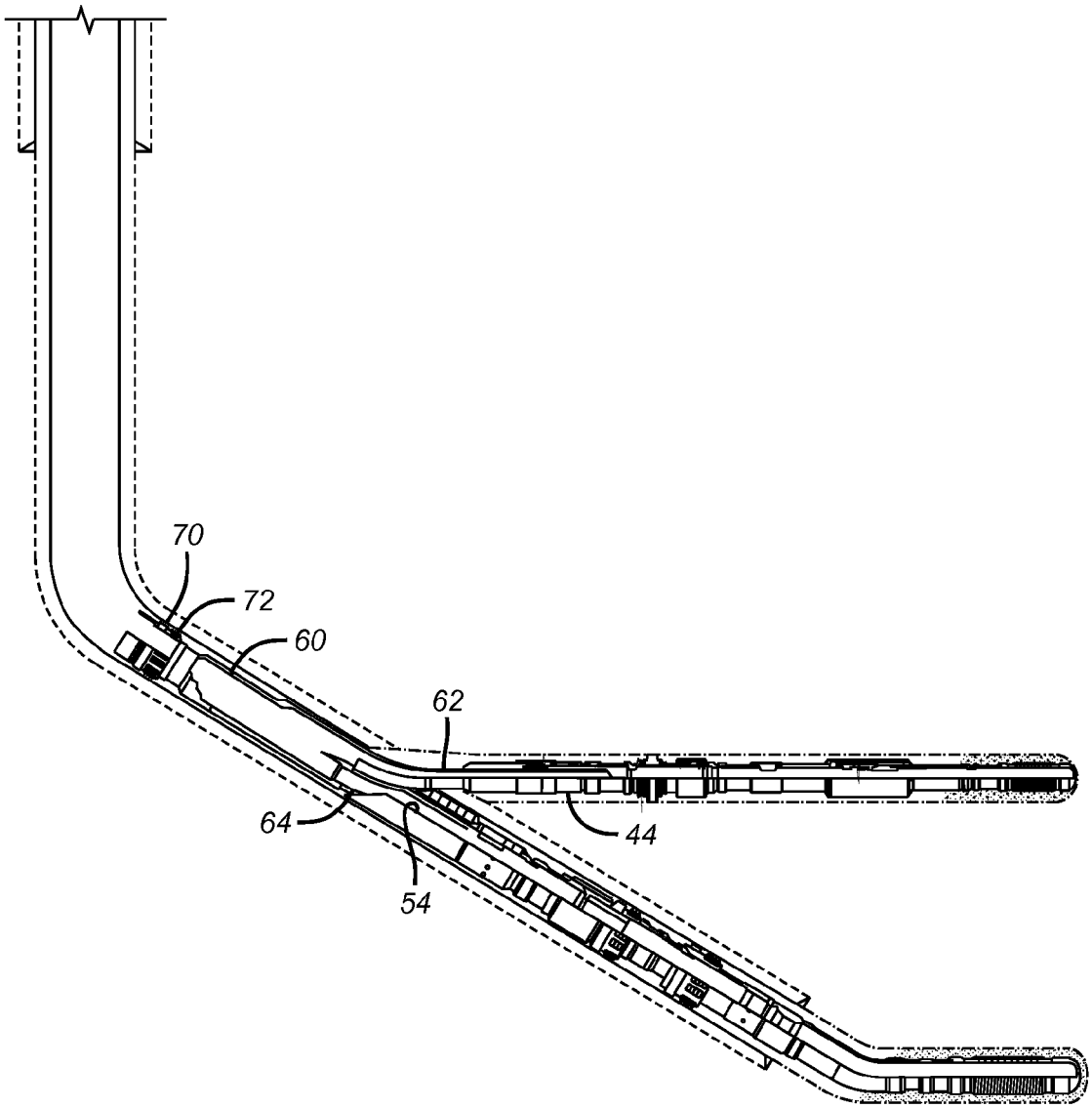
FIG. 6 is the view of FIG. 5 showing the junction in position sealed to the seal bores in the main bore and the lateral and supported by an isolation packer in the set position after the removal of the running string that delivered the junction.

FIG. 6 illustrates a junction 60 having a leg 62 initially stabbed into seal bore 44 and through the use of known positioning tools the other leg 64 is stabbed into seal bore 54. The hanger/packer 70 having a seal bore 72 is shown in the set position and the running string that delivered the junction 60 has been removed. A production string can be stabbed into seal bore 72 and the main bore 14 and/or the lateral 10 can then be produced individually or together.

Figure 7:
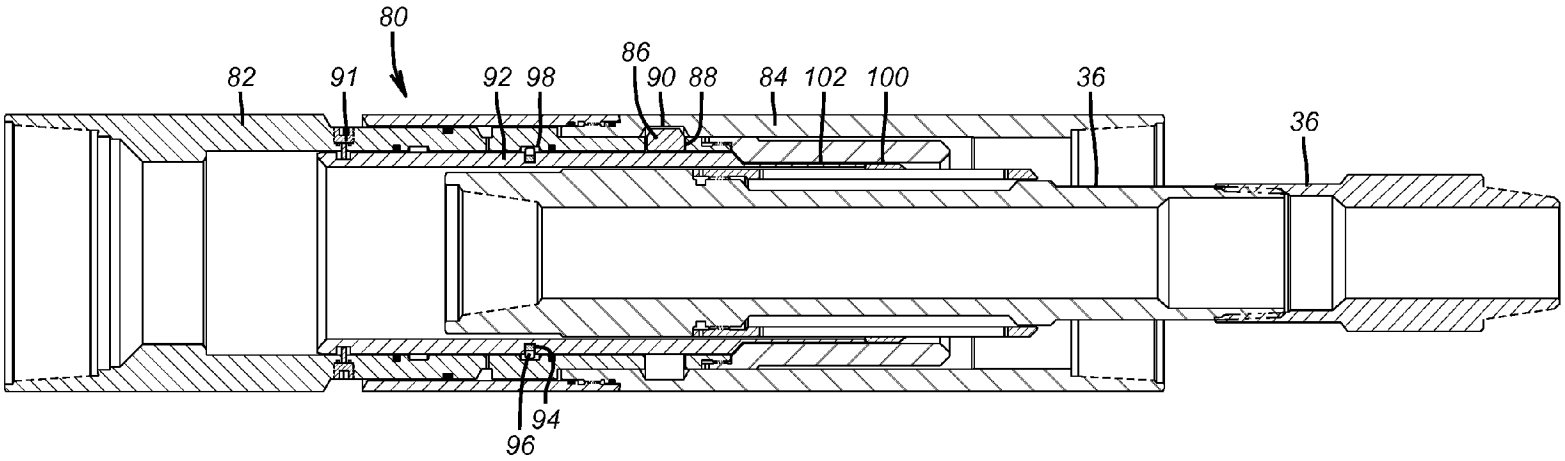
FIG. 7 shows the disconnect between the packer in the lateral and the main bore packer shown in FIG. 2 in the locked position with the inner string running through it.
Figure 8:
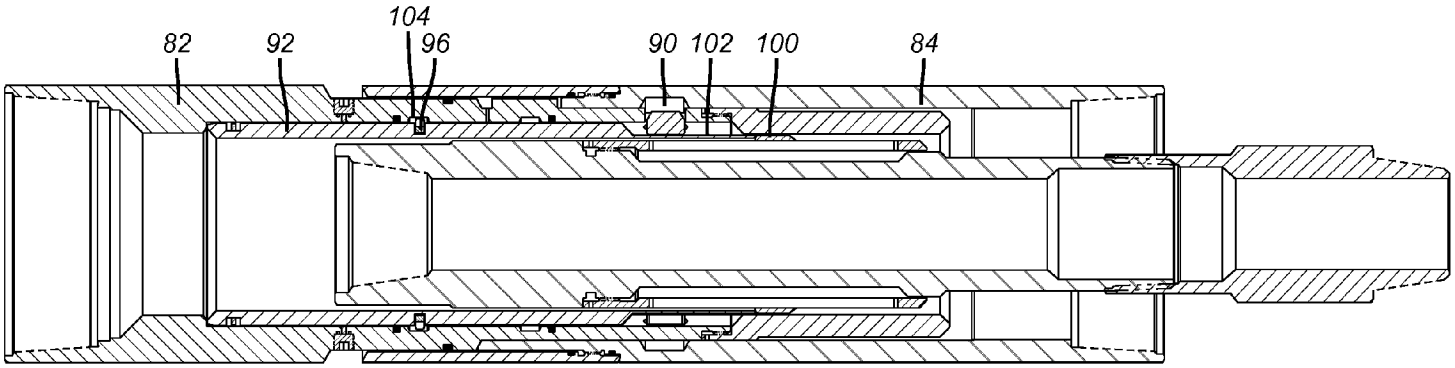
FIG. 8 is the view of FIG. 7 with the disconnect released so that the upper portion can come out of the hole with the inner string and the main bore packer.
Figure 9:
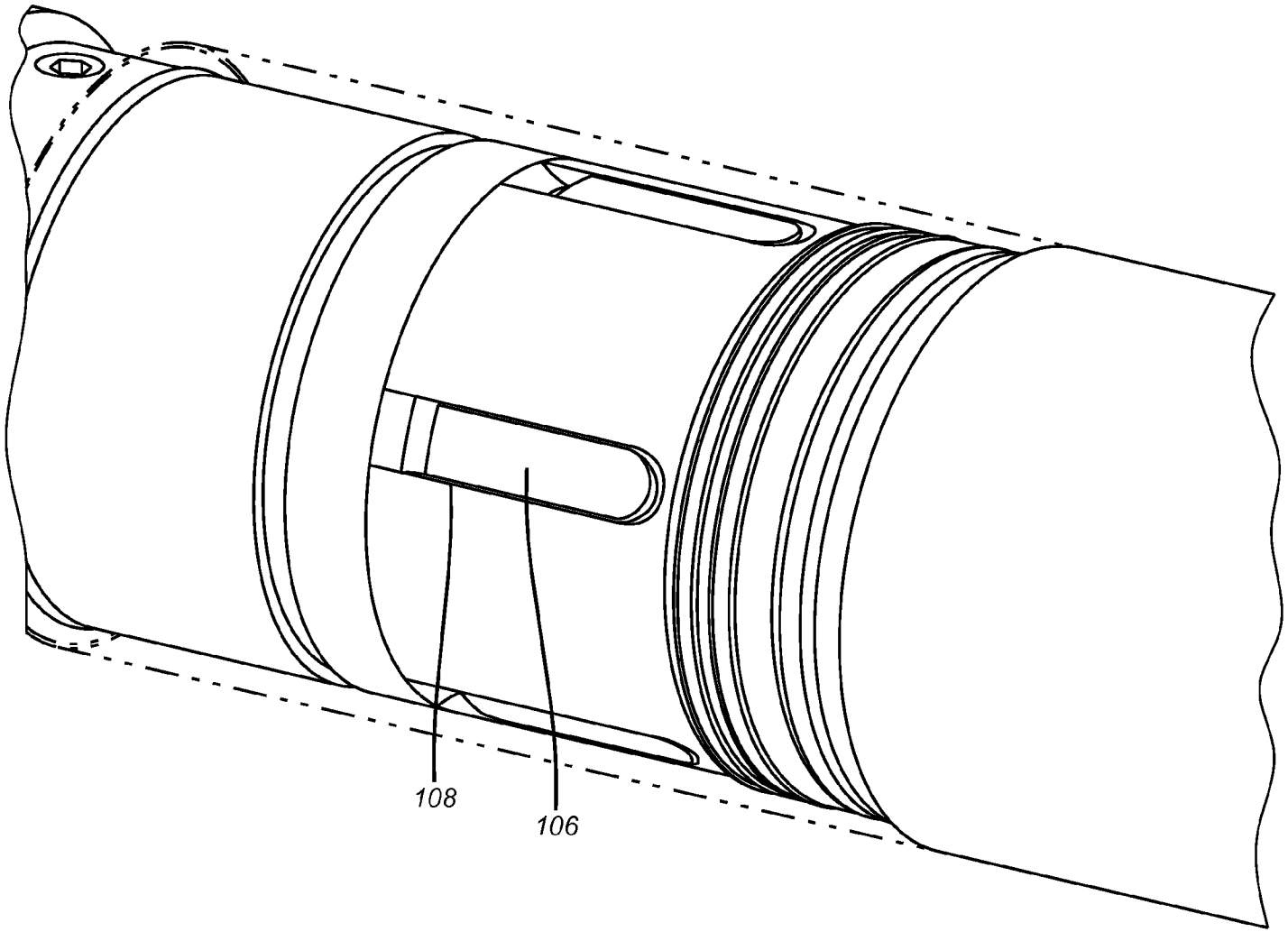
FIG. 9 is a detailed view of the disconnect showing the torque transmission feature.

FIG. 7 shows the disconnect 80 having an upper portion 82 and a lower portion 84. Dogs 86 are in windows 88 in the upper portion 82 and extend into conforming recesses 90 in the lower portion 84. A sleeve 92 has a groove 94 in which resides a snap ring 96 that is biased into a surrounding groove 98 in the upper portion 82. A portion of the inner string 36 passes through the sleeve 92 and has a shoulder 100 that on upward movement engages the sleeve 92 for tandem movement. Such tandem movement breaks shear pins 91 and brings surface 102 even with the dogs 86 to allow them to move out of groove 90 as shown in FIG. 8. At the same time the snap ring 96 snaps into groove 104 to lock the position of sleeve 92 in the FIG. 8 position. At this point the inner string 36 continues moving up where a shifting member on it that is not shown will eventually release the main bore packer 40 and continued upward movement of the inner string separates the upper portion 82 from the lower portion 84 while seal bore 44 just below the lower portion 84 will now be exposed to accept leg 62 of the junction 60 when delivered in the next trip. The disconnect 80, also referred to as 38 in FIG. 2, transmits torque from upper section 82 to lower section 84 using ridges 106 on the upper section 82 that mesh into slots 108 in the lower section 84 as shown in FIG. 9. The arrangement can be reversed or differently designed to avoid transmission of torque through the dogs 86.

Those skilled in the art will appreciate that in a single trip a gravel packing can be accomplished in a lateral without the junction in place so that a larger completion can be run. The main bore packer can then be released from the isolation packer in the lateral with a disconnect so that the inner string can take with it a part of the disconnect to expose a seal bore in the lateral and the main bore packer. The junction can then be run and tagged into seal bores in the main bore and in the lateral for production through the main bore or the lateral or both using a production string tagged into a packer delivered. The method saves an extra step of individually removing the main bore packer by using a disconnect to allow removal of the main bore packer with the inner string that releases not only the disconnect but also the upper packer so they can be removed in tandem.

The above description is illustrative of the preferred embodiment and many modifications may be made by those skilled in the art without departing from the invention whose scope is to be determined from the literal and equivalent scope of the claims below:

We claim:

1. A method of gravel packing a lateral in a multilateral well, comprising:

running into a lateral, when a junction is not present, on a running string extending from a surface location, a gravel packing assembly comprising an isolation packer, a screen assembly and a crossover, said running string further comprising a main bore packer disposed outside the lateral;

performing the gravel pack in the lateral through said running string without removal of said running string from said running;

disconnecting said main bore packer from said isolation packer in the lateral by manipulation of said running string that remained in the hole from said running and performing;

removing said main bore packer with said running string that remained in the hole from said running, performing and disconnecting all in a single trip.

2. The method of claim 1, comprising:

using a disconnect between said main bore packer and said isolation packer for said disconnecting.

3. The method of claim 2, comprising:

actuating said disconnect with a wash pipe on said running string extending through said disconnect and into said gravel packing assembly.

4. The method of claim 1, comprising:

undermining support for at least one dog holding an upper component of said disconnect to a lower component of said disconnect to allow separation.

5. The method of claim 4, comprising:

moving a sleeve to align a recess with said at least one dog to accomplish said undermining.

6. The method of claim 5, comprising:

locking said sleeve with said at least one dog undermined to prevent said at least one dog from being again supported.

7. The method of claim 1, comprising:

exposing a seal bore in said lateral by said disconnecting.

8. The method of claim 7, comprising:

delivering in another trip a junction to sealingly engage said seal bore in said junction.

9. The method of claim 8, comprising:

providing a seal bore in a main bore completion;

engaging said junction sealingly into said seal bore in said main bore.

10. The method of claim 9, comprising:

associating a whipstock with said seal bore in said main bore;

using said whipstock to direct said gravel packing assembly into said lateral.

11. The method of claim 10, comprising:

removing said whipstock to expose said seal bore in said main bore before said delivering of said junction.

12. The method of claim 11, comprising:

using a disconnect between said main bore packer and said isolation packer for said disconnecting.

13. The method of claim 12, comprising:

actuating said disconnect with a wash pipe on said running inner string extending through said disconnect and into said gravel packing assembly.

14. The method of claim 13, comprising:

undermining support for at least one dog holding an upper component of said disconnect to a lower component of said disconnect to allow separation.

15. The method of claim 14, comprising:

moving a sleeve to align a recess with said at least one dog to accomplish said undermining.

16. The method of claim 15, comprising:

locking said sleeve with said at least one dog undermined to prevent said at least one dog from being again supported.

* * * * *